US008826829B2

(12) United States Patent
Taylor

(10) Patent No.: US 8,826,829 B2
(45) Date of Patent: Sep. 9, 2014

(54) FOLDABLE WORK BENCH STATION

(76) Inventor: Harry Randall Taylor, Whittier, CA (US)

( * ) Notice: Subject to any disclaimer, the term of this patent is extended or adjusted under 35 U.S.C. 154(b) by 0 days.

(21) Appl. No.: 13/421,837

(22) Filed: Mar. 15, 2012

(65) Prior Publication Data

US 2012/0260833 A1 Oct. 18, 2012

Related U.S. Application Data

(60) Provisional application No. 61/453,076, filed on Mar. 15, 2011.

(51) Int. Cl.
*A47B 3/00* (2006.01)

(52) U.S. Cl.
USPC ..... 108/34; 108/48

(58) Field of Classification Search
USPC ..... 144/285, 286.5, 286.1, 287; 108/115, 108/134, 48, 33–36, 38, 40, 128; 312/313, 312/314, 317.1, 317.3, 248, 246, 315, 316, 312/245
See application file for complete search history.

(56) References Cited

U.S. PATENT DOCUMENTS

| | | | | | |
|---|---|---|---|---|---|
| 593,828 | A | * | 11/1897 | Ank | 108/134 |
| 605,198 | A | * | 6/1898 | Elliot | 434/130 |
| 943,236 | A | * | 12/1909 | Campbell | 108/115 |
| 1,158,212 | A | * | 10/1915 | Henderson | 108/115 |
| 1,197,891 | A | * | 9/1916 | Barnes | 108/134 |
| 1,809,028 | A | * | 6/1931 | Fanarjian | 312/310 |
| 2,055,007 | A | * | 9/1936 | Erpelding | 108/124 |
| 2,587,177 | A | * | 2/1952 | Larson | 144/286.1 |
| 2,702,223 | A | * | 2/1955 | Mucher | 248/188.91 |
| D336,394 | S | * | 6/1993 | Ball | D6/487 |
| 5,592,887 | A | * | 1/1997 | Teng | 108/134 |
| 5,775,655 | A | * | 7/1998 | Schmeets | 248/240 |
| 5,967,054 | A | * | 10/1999 | Rosenfeld | 108/44 |
| 6,039,416 | A | * | 3/2000 | Lambert | 312/245 |
| 6,041,723 | A | * | 3/2000 | Peterson | 108/115 |
| 6,314,892 | B1 | * | 11/2001 | Favini | 108/115 |
| 6,811,233 | B1 | * | 11/2004 | Packer | 312/313 |

(Continued)

FOREIGN PATENT DOCUMENTS

| | | |
|---|---|---|
| JP | 20011046153 | 2/2001 |
| KR | 20-0232954 | 10/2001 |
| WO | WO 2006/130563 A2 | 12/2006 |

OTHER PUBLICATIONS

International Search Report dated Oct. 29, 2012 for PCT/US2012/029312 (3 sheets).

*Primary Examiner* — Janet M Wilkens
(74) *Attorney, Agent, or Firm* — Fish & Associates, PC

(57) ABSTRACT

A work bench station comprises a pair of spaced-apart mounting brackets for attachment to a building wall. A workbench tabletop is hingedly attached to the wall brackets so that the tabletop can swing between a horizontal working position upwardly or downwardly to a generally vertical storage position. K-shaped end supports are hingedly attached to the wall brackets and can swing from a working position supporting the tabletop in its working position, inwardly to a storage position generally against or adjacent to the building wall.

19 Claims, 13 Drawing Sheets

(56) References Cited

U.S. PATENT DOCUMENTS

| | | | | |
|---|---|---|---|---|
| 6,817,302 | B2 * | 11/2004 | Norstad | 108/115 |
| 7,360,260 | B2 * | 4/2008 | Gallawa et al. | 5/2.1 |
| 2005/0061212 | A1 * | 3/2005 | Lockwood et al. | 108/115 |
| 2005/0252427 | A1 * | 11/2005 | Hand | 108/115 |
| 2008/0017083 | A1 * | 1/2008 | VanNimwegen et al. | 108/121 |
| 2008/0272266 | A1 * | 11/2008 | Eustace et al. | 248/423 |
| 2011/0203490 | A1 * | 8/2011 | Carter | 108/26 |
| 2012/0119428 | A1 * | 5/2012 | Kirchgessner | 269/289 R |

* cited by examiner

FIG. 1C
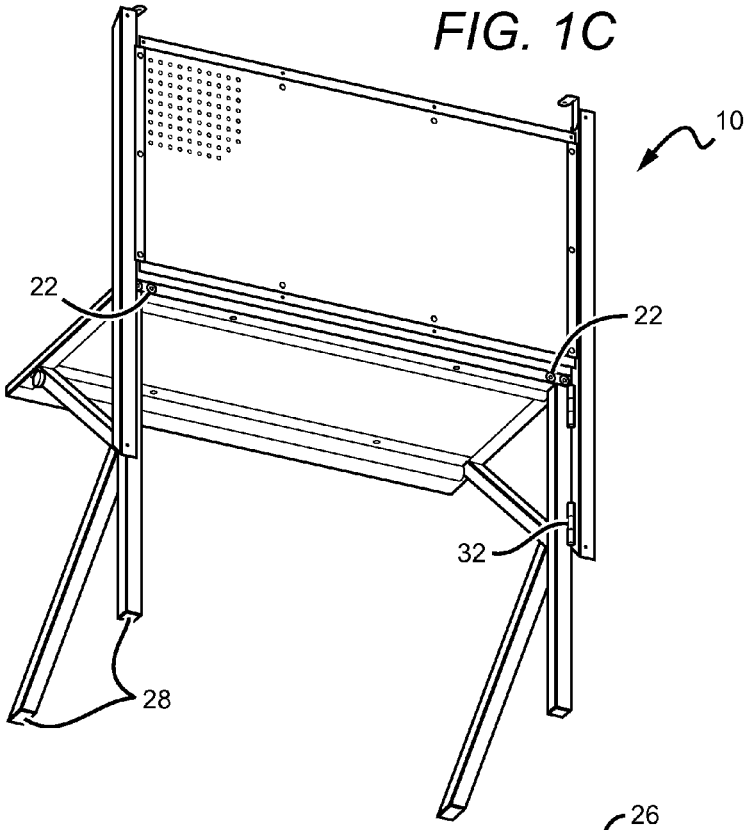
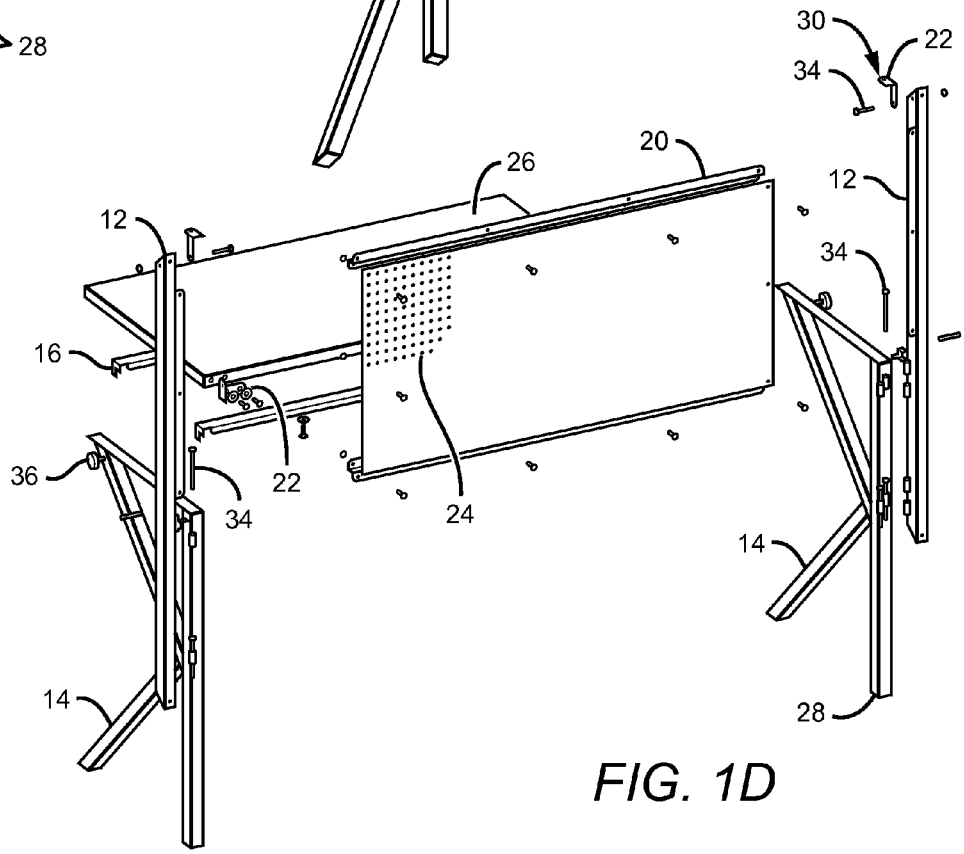
FIG. 1D

FIG. 2
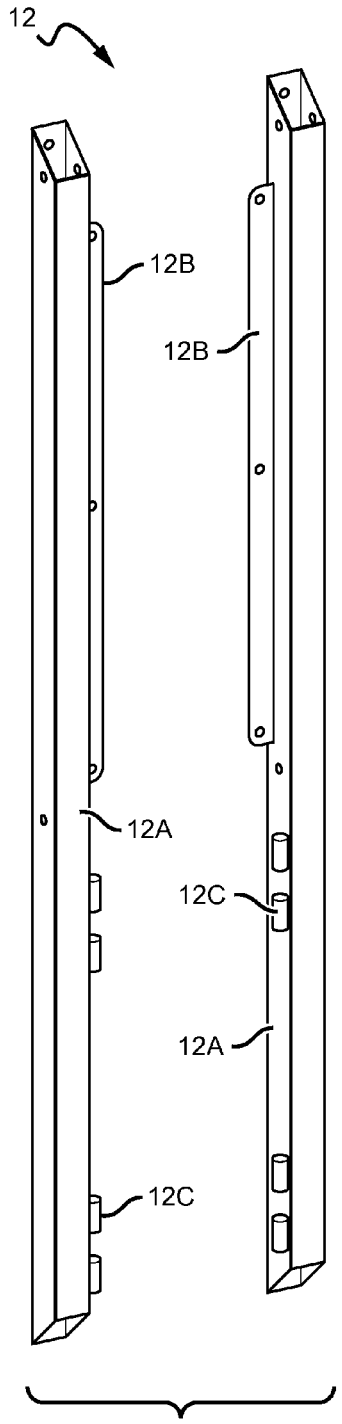
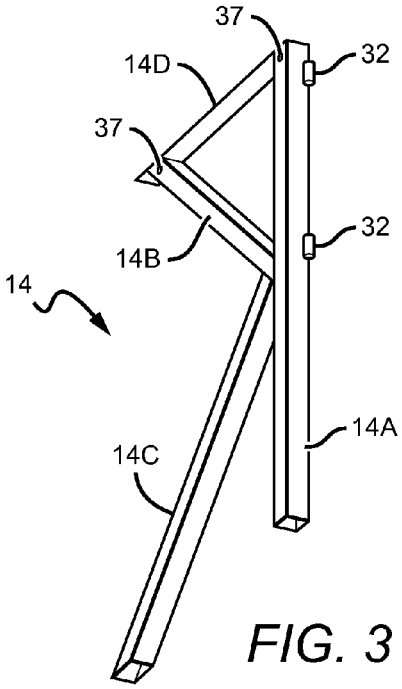
FIG. 3
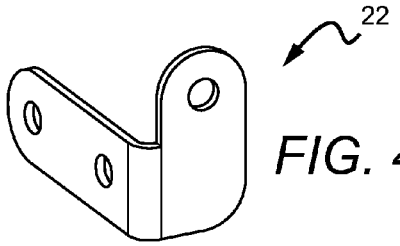
FIG. 4A
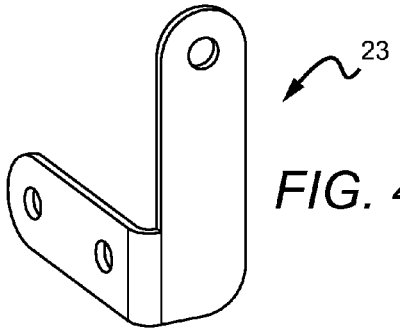
FIG. 4B

FIG. 5
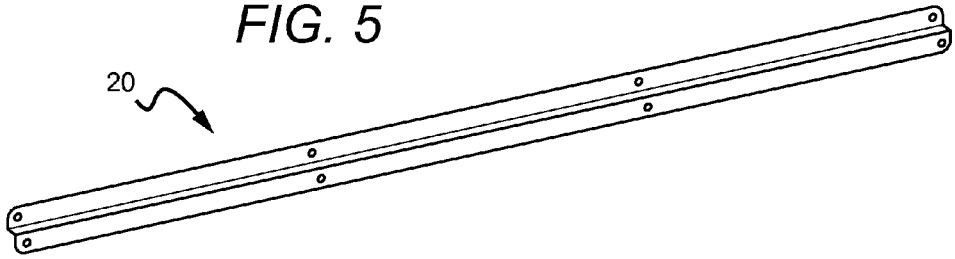
FIG. 6
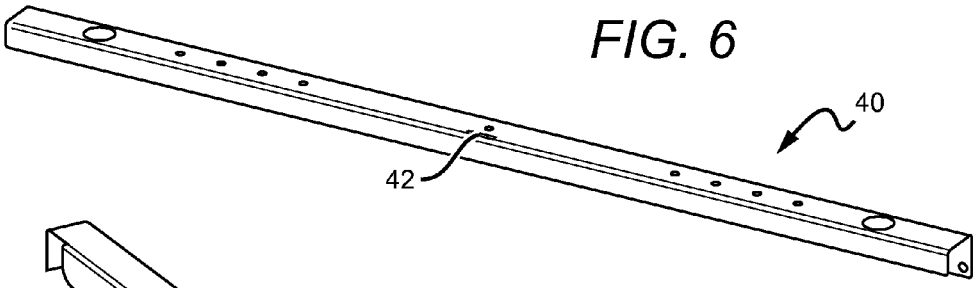
FIG. 7
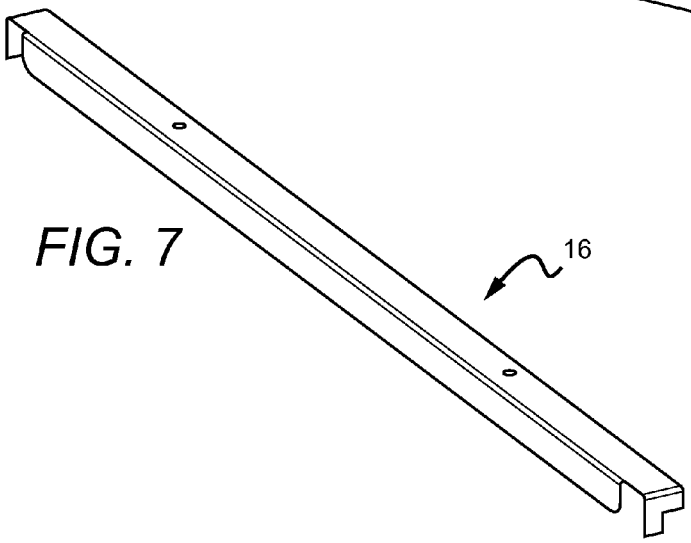
FIG. 8
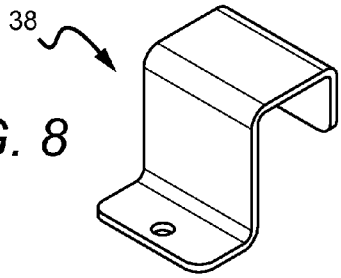
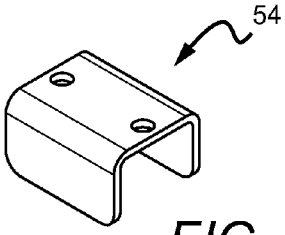
FIG. 9

FOLDABLE WORK BENCH STATION

CROSS-REFERENCE TO RELATED APPLICATION(S)

This non-provisional application claims the benefit of U.S. Provisional Patent Application No. 61/453,076, filed in the U.S. Patent and Trademark Office on Mar. 15, 2011, the entire contents of which are incorporated herein by reference.

BACKGROUND OF THE INVENTION

The present invention relates to a work bench station. Typical work benches are free-standing units having a generally horizontal working surface supported by vertical legs. These work benches require at least an amount of space equal to the dimensions of the horizontal working surface. Some work benches have a panel, e.g., made of pegboard or the like, that extends above and at the rear of the horizontal working surface on which lightweight tools and the like may be removably mounted.

SUMMARY OF THE INVENTION

The present invention provides a work bench station that comprises a work bench that can be mounted on and folded against a wall when not in use to minimize space occupied by the work bench station. The work bench station comprises at least one right and one left wall bracket, that may be fixedly attached to a generally vertical wall of a building, e.g., of a home garage. The brackets may be of any design that provide adequate support for the other components of the work bench station. Presently preferred wall brackets comprise generally vertically oriented, right and left metal tubes having a square cross-sectional configuration.

A tabletop which provides a generally horizontal working surface, extends generally horizontally outwardly from the wall brackets and is hingedly attached to the wall brackets so that the tabletop can swing upwardly to a generally vertical "up" storage position and/or downwardly to a generally vertical "down" storage position. The tabletop can be made of wood or any other suitable material. Optionally, a generally vertical panel, preferably of pegboard, and preferably having an upper and lower frame for stabilizing the panel, may be attached to and extend between the right and left wall brackets at an elevation above a generally horizontal tabletop.

In one embodiment, the work bench station comprises a pegboard panel between the wall brackets and a hinge connection between the tabletop and the wall brackets and are such that the tabletop may swing up to a vertical up storage position spaced apart from the pegboard panel so that tools or other objects mounted on the pegboard need not be removed. The tabletop may be releaseably maintained in its up and/or down storage position by a locking mechanism, e.g., a locking bracket.

The work station further comprises generally planar end support structures that support the tabletop at its ends. The end support structures are hingedly connected to the wall brackets such that they can swing inwardly from a working position to a folded storage position lying against or adjacent to the wall of the building. In one exemplary embodiment, the end support structures are K-shaped supports, e.g., as described in U.S. patent application Ser. No. 11/800,409, which is incorporated herein by reference, are used. It is understood that other configurations of end support structures, e.g., H-shaped, inverted L or U shapes, square, rectangular or triangular shapes and the like, that provide support for the tabletop when it is in its working position and can swing inwardly to a storage position, may be used as desired.

BRIEF DESCRIPTION OF THE DRAWINGS

FIG. 1C is a rear perspective view of the work bench station of FIG. 1 in its working configuration.

FIG. 1D is a rear exploded view of the work bench station of FIG. 1 in its working configuration.

FIG. 2 is a perspective view of exemplary right and left wall brackets according to the invention.

FIG. 3 is a perspective view of an exemplary K-leg style end support structure.

FIG. 4A and 4B are perspective views of exemplary tabletop hinge brackets.

FIG. 5 is a perspective view of an exemplary upper or lower peg board framing member.

FIG. 6 is a perspective view of another exemplary upper peg board framing member.

FIG. 7 is a perspective view of an exemplary tabletop reinforcing beam.

FIG. 8 is a perspective view of an exemplary locking bracket.

FIG. 9 is a perspective view of another exemplary locking bracket.

FIG. 12K-1 and 12K-2 are an enlarged side view of the locking bracket mechanism of the work bench stations of FIGS. 12I and 12J, respectively, in their folded configuration.

DETAILED DESCRIPTION

The detailed description set forth below in connection with the drawings is intended as a description of embodiments of a work bench station in accordance with the present invention and is not intended to represent the only forms in which the invention may be constructed or utilized. It is to be understood that the same or equivalent functions and structures may be accomplished by different embodiments that are also intended to be encompassed within the spirit and scope of the invention. As denoted elsewhere herein, like element numbers indicate like elements or features.

In a first exemplary embodiment, shown in FIGS. 1A-1D, the work bench station 10 comprises a right and left wall bracket 12 mountable by screws, bolts and the like to a generally vertical wall of a home garage or other structure.

Figure 12B:
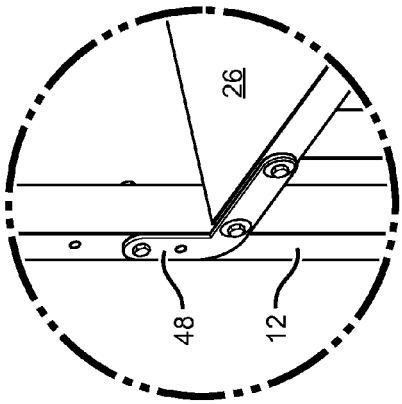
FIG. 12B is an enlarged front perspective view of the tabletop hinge bracket of the work bench station of FIG. 12A in its working configuration.
Figure 12D:
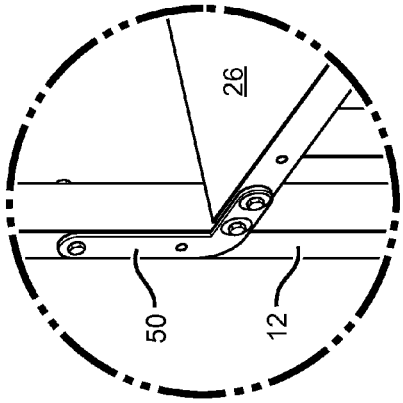
FIG. 12D is an enlarged front perspective view of the tabletop hinge bracket of the work bench station of FIG. 12C in its working configuration.
Figure 12A:
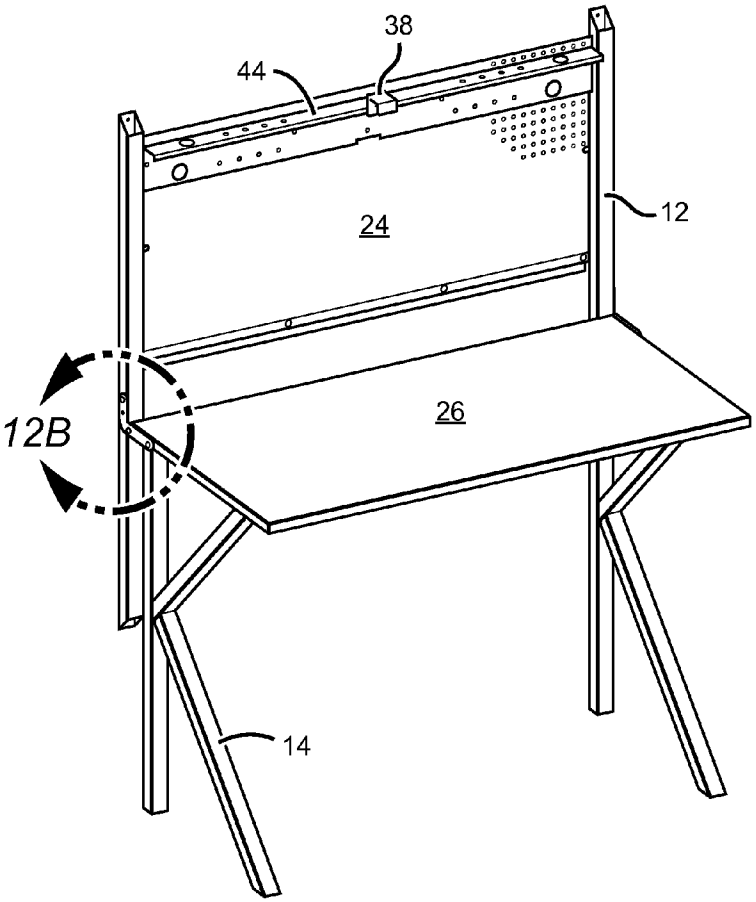
FIG. 12A is a front perspective view of a work bench station according to a fourth embodiment of the present invention in its working configuration.
Figure 12E:
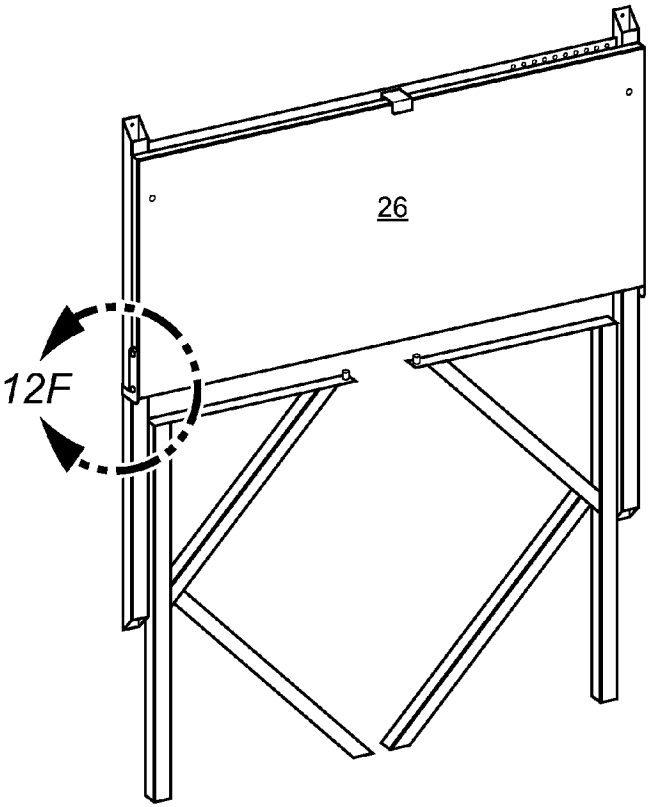
FIG. 12E is a front perspective view of the work bench station of FIG. 12A in its folded configuration.
Figure 12C:
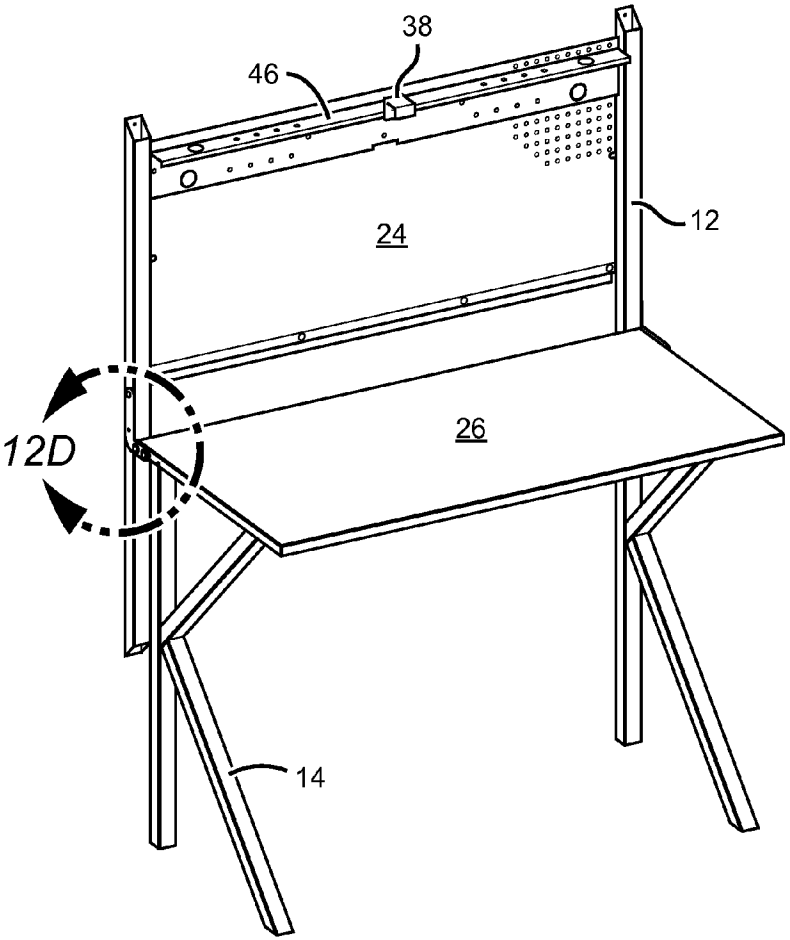
FIG. 12C is a front perspective view of a variation of the work bench station of FIG. 12A in its working configuration.
Figure 12G:
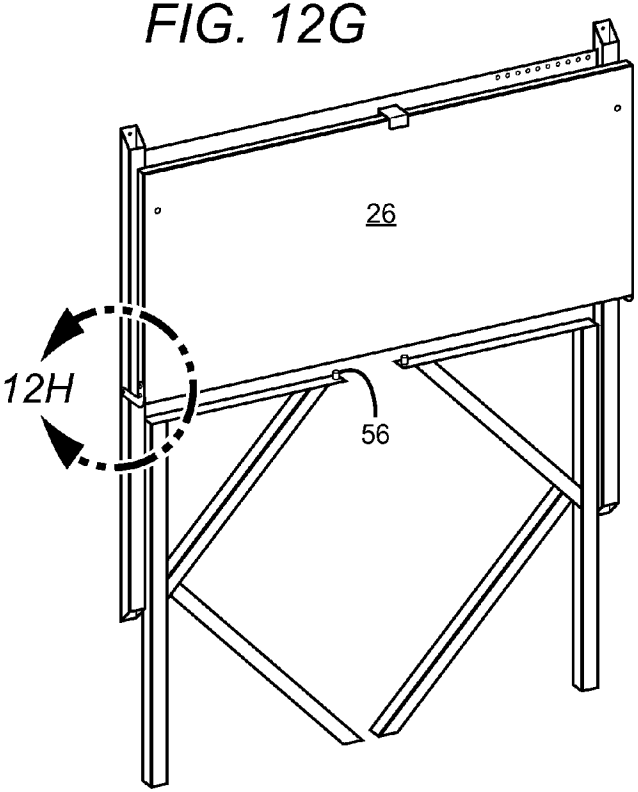
FIG. 12G is a front perspective view of the work bench station of FIG. 12C in its folded configuration.
Figure 12F:
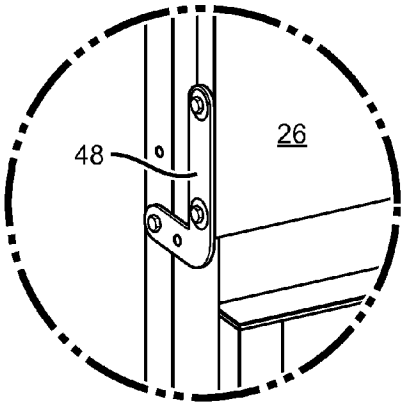
FIG. 12F is an enlarged front perspective view of the tabletop hinge bracket of the work bench station of FIG. 12E in its folded configuration.
Figure 12H:
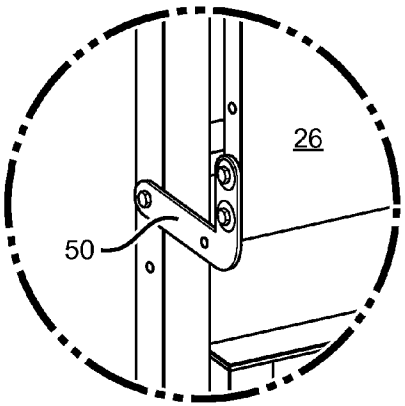
FIG. 12H is an enlarged front perspective view of the tabletop hinge bracket of the work bench station of FIG. 12G in its folded configuration.
Figure 12I:
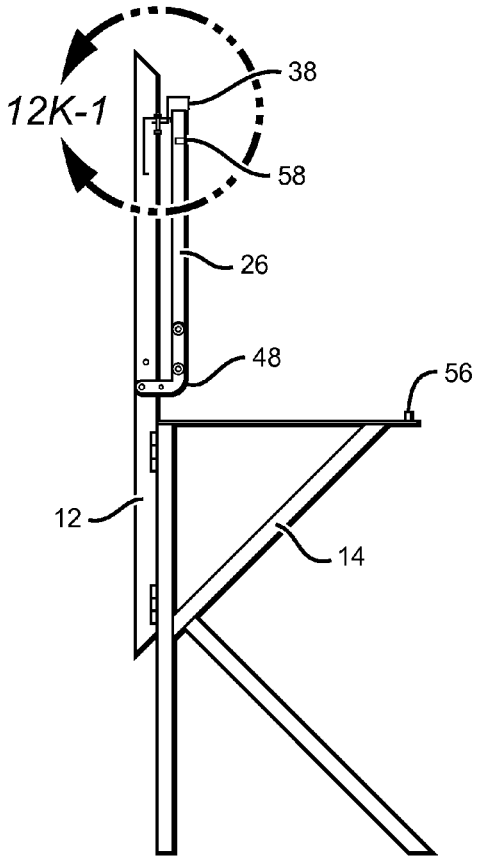
FIG. 12I is a side view of the work bench station of FIG. 12A in its folded configuration.
Figure 12J:
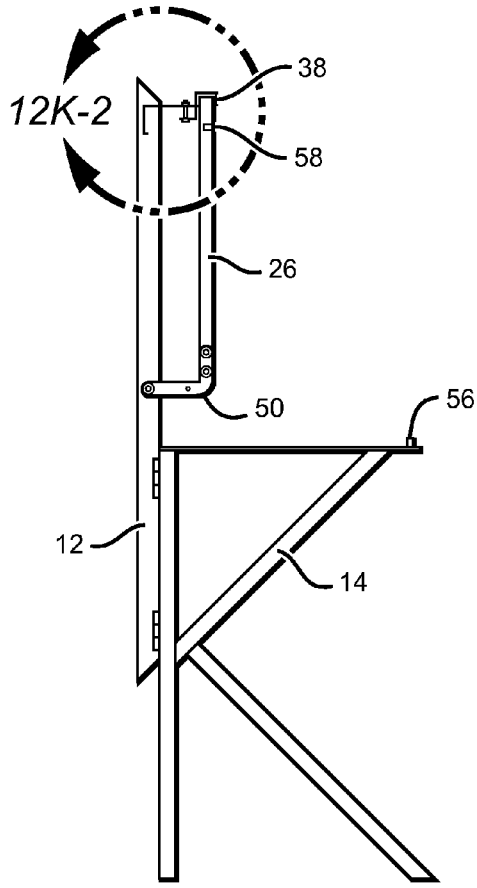
FIG. 12J is a side view of the work bench station of FIG. 12C in its folded configuration.
Figures 1, 12K:
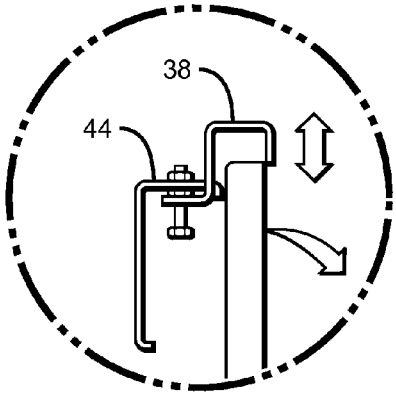
Figures 2, 12K:
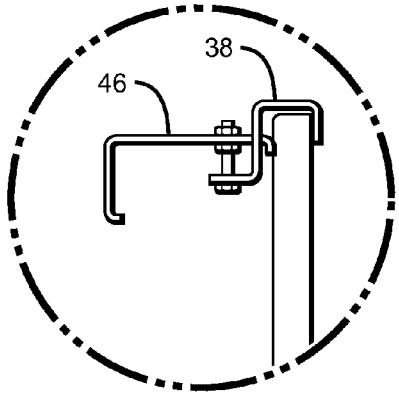

As shown in FIG. 2, the wall bracket 12 of this embodiment comprises a metal tube 12A having a generally square cross-sectional configuration. The metal tube is 1.5 inch by 1.5 inch, 14 gauge steel tube. It is understood that other dimensions and thicknesses may be used and that the tube may comprise two or more sections, each individually mountable on the building wall. Brackets having rectangular, L-shaped or C-shaped cross-sectional configurations or any other suitable brackets may also be used. The brackets must be sufficiently strong to support the pegboard panel, tabletop and end supports in the station's folded, storage configuration. A flange 12B extends inwardly from the metal tube along an upper portion of the metal tube 12A and 12B and sections 12C of a panel type hinge are positioned along a lower portion of the metal tube 12A.

The work bench station 10 further comprises a pegboard panel 24 which extends between the wall brackets 12. In this embodiment, the pegboard panel 24 is supported by upper and lower, generally horizontal frame members 20, that extend above and below the peg board panel and are mounted at their ends to the wall brackets 12.

Figure 1B:
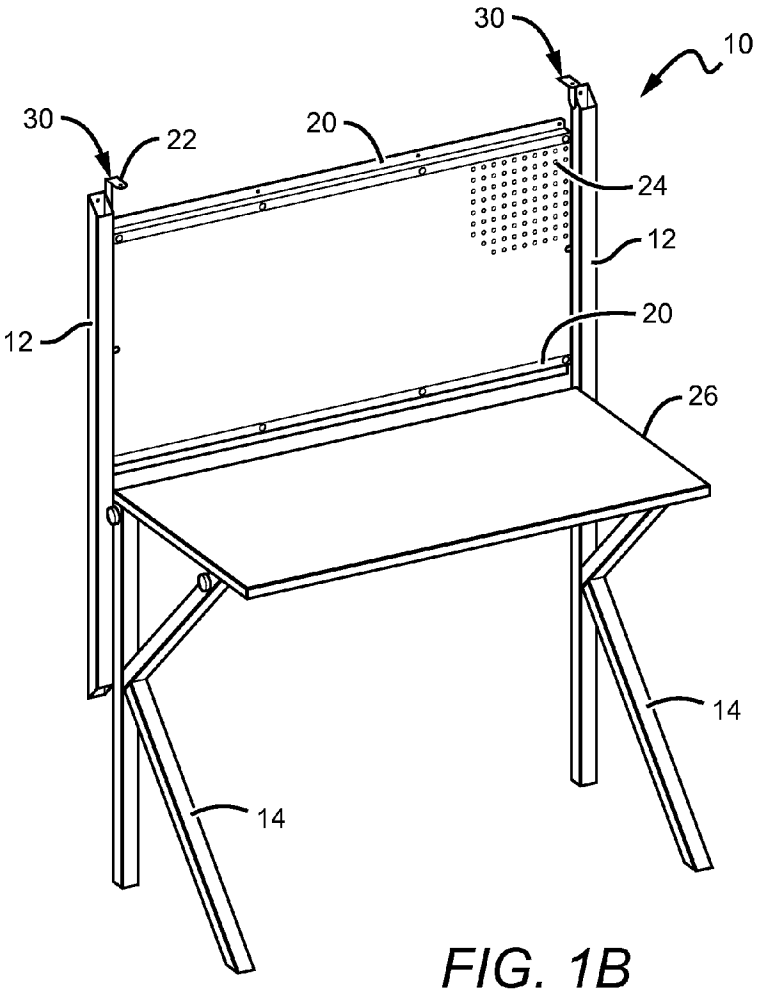
FIG. 1B is a front perspective view of the work bench station of FIG. 1 in its working configuration.
Figure 1A:
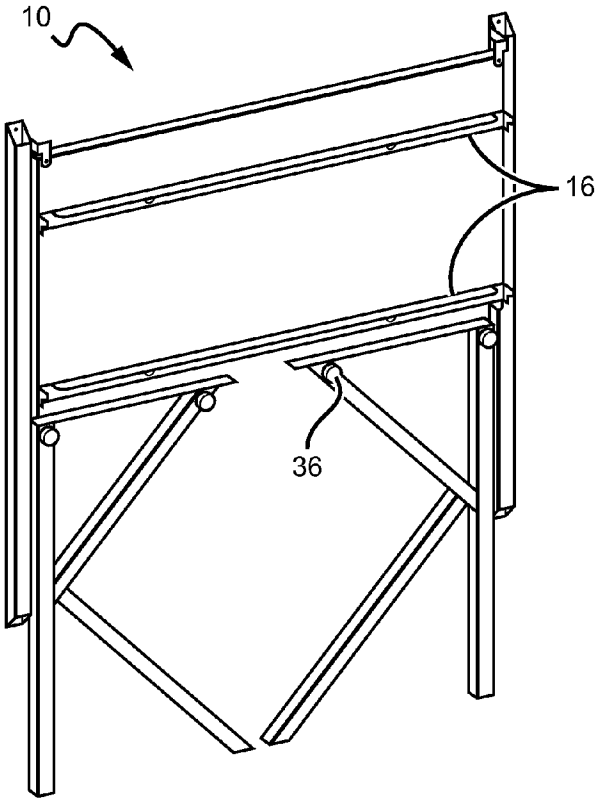
FIG. 1A is a front perspective view of a work bench station according to a first embodiment of the present invention in its folded storage configuration.

In the embodiment tabletop 26 is reinforced and supported on its bottom side by front and rear cross beams 16 (shown, for example, in FIGS. 1A and 7). It is understood that if the tabletop is sufficiently strong by itself, reinforcing cross beams would not be required. Further, the dimensions of the tabletop are also a matter of design choice. Parallel lengths are 48", 60", 72", and 96".

A hinge bracket 22 (shown, for example, in FIGS. 1D and 4A) is fixedly attached, e.g., by bolts, to the back of the tabletop 26 to pivotedly attach to the wall brackets 12, e.g., by means of a lag bolt that allows the bracket 22 to pivot about the shaft of the bolt.

A latch 30 is provided at the upper ends of the wall brackets 12. The latch 30 comprises a hinge bracket 22 (shown in FIG. 4A) which is attached to the wall bracket by a lag bolt which allows it to pivot from an unlatched position as shown in FIG. 1B to a latched position as shown in FIG. 1A which captures the tabletop 26 once it has been folded into its storage position.

The end supports 14 of the embodiment of FIGS. 1A-1D have a K-shaped configuration. Suitable K-shaped supports are described in U.S. patent application Ser. No. 11/800,409, which is incorporated herein by reference. The K-shaped supports have a rear leg 14*a*, an upper front leg 14*b* and a lower front leg 14*c* and a horizontal plate 14*d*. Each K-shaped support in hingedly attached to the wall brackets 12 by a barrel hinge, formed by barrel components 12*c* on the wall brackets 12 and barrel components 32 on the end supports and pin 34 (see FIG. 1C). The hinge is designed to allow the K-shaped supports to lift and pivot or swing about the pin 34. The barrel component of the hinge may be integrated with the wall bracket 12 or fixedly attached thereto by screws or the like.

When the work bench station is in its working configuration, the K-shaped end support 14 releaseably engages the tabletop 26. In the embodiment of FIGS. 1A-1D, this is done by rosette head bolts 36 which extend through holes 37 (see FIG. 3) in each of the upper front leg and rear leg of the K-shaped end support 14 and engage the ends of the front and rear support cross beams 16. In their storage positions, the end supports 14 lie against or generally parallel to the building wall. In an embodiment, the K-shaped end supports lie against the lower horizontal pegboard frame member 20 and are releasably secured thereto by one or more magnets attached to the horizontal plate 14D of the K-shaped end support at locations where the horizontal plate 14D contacts the lower pegboard frame member 70.

In the embodiment of FIGS. 1A-1D, the bottom ends of the lower front leg and rear leg of the K-shaped end support 14 are fitted with plastic end caps 28 which allow the end supports to slide over a floor during folding. It is understood that, if a metal tube is used for any of the wall brackets 12 or end supports 14, any open end may be fitted with an end cap, if desired.

In the embodiment of FIGS. 1A-1D, the tabletop 26 may swing upwardly from a working position as shown in FIG. 1B to a generally vertical storage position as shown in FIG. 1A. The latch 30 maintains the tabletop 26 in its storage position until the latch 30 is released. In this embodiment, the tabletop 26 is folded against the pegboard panel. Hence, no tools can be left on the pegboard when the tabletop is folded to its storage position.

Figure 10B:
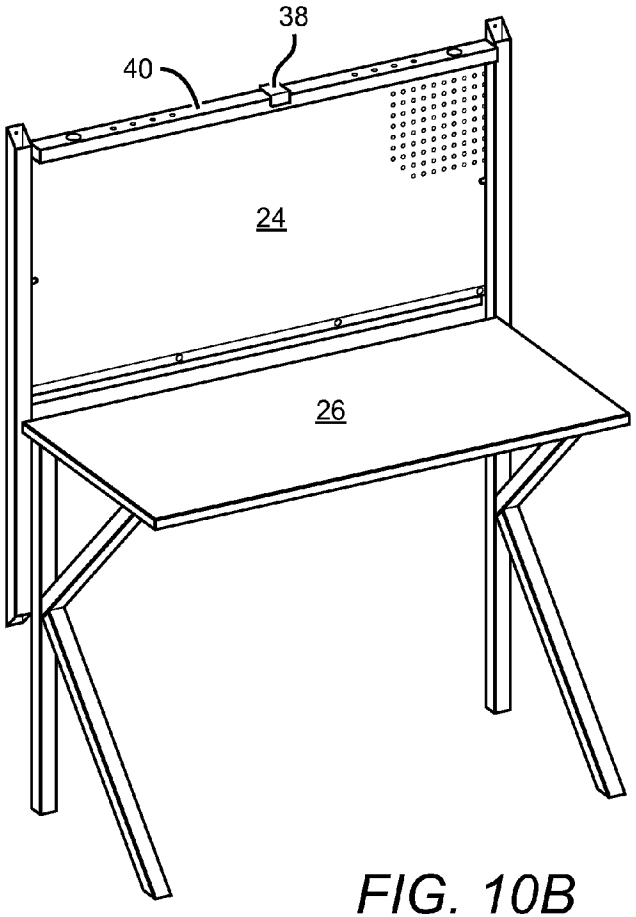
FIG. 10B is a front perspective view of the work bench station of FIG. 10A in its working configuration.
Figure 10A:
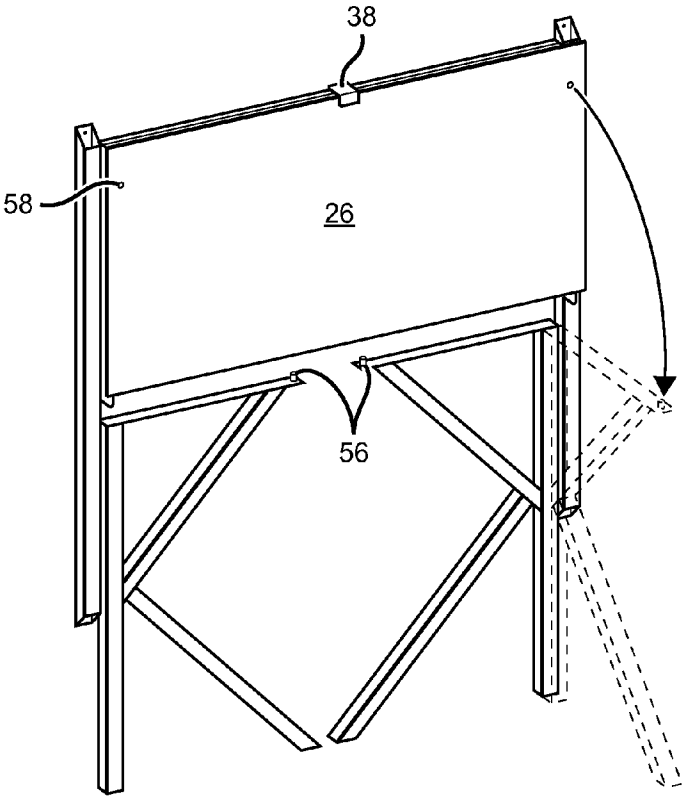
FIG. 10A is a front perspective view of a work bench station according to a second embodiment of the present invention in its folded storage configuration.
Figure 11A:
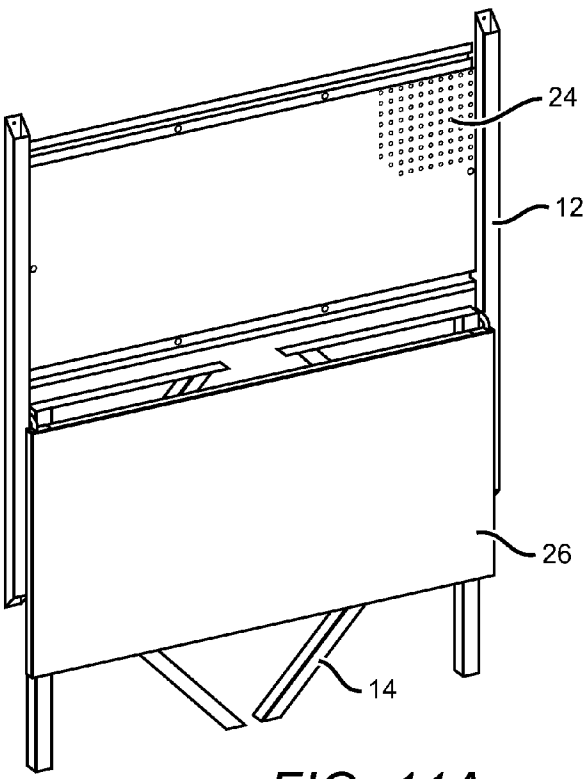
FIG. 11A is a perspective view of a work bench station according to a third embodiment of the present invention in its folded storage configuration.
Figure 10C:
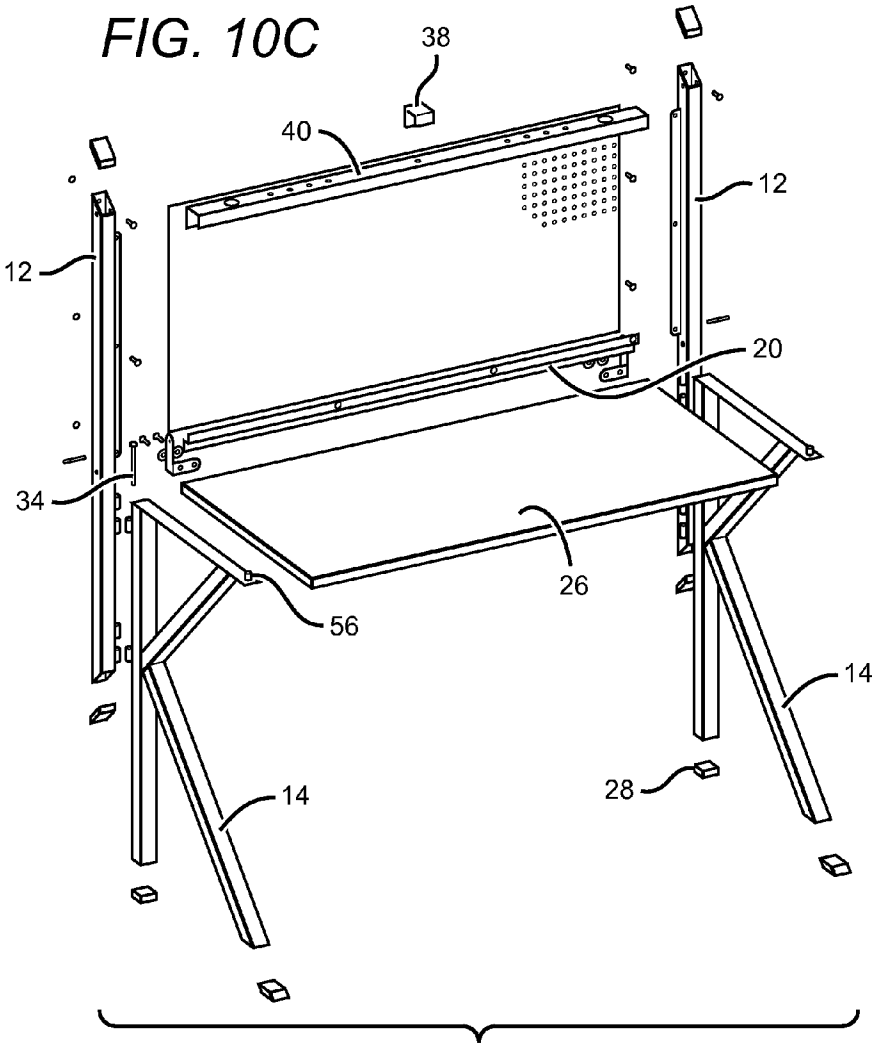
FIG. 10C is a rear exploded view of the work bench station of FIG. 10A in its working configuration.
Figure 11C:
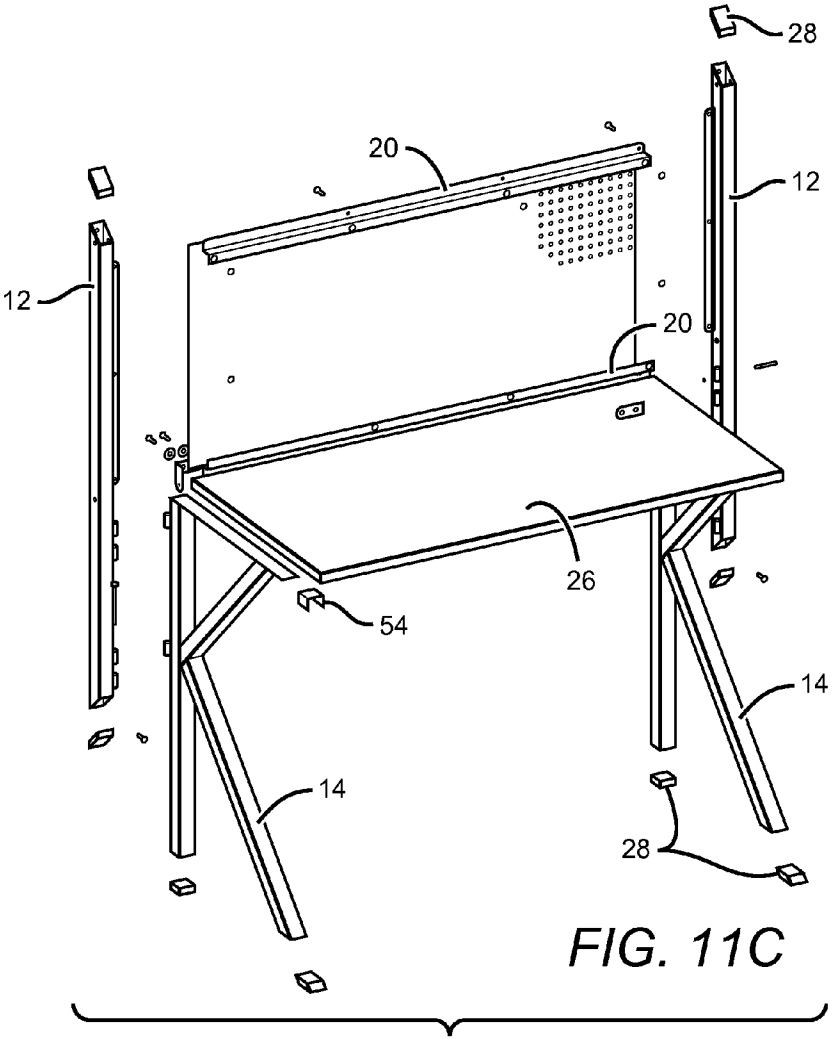
FIG. 11C is a rear exploded view of the work bench station of FIG. 11A in its working configuration.
Figure 11B:
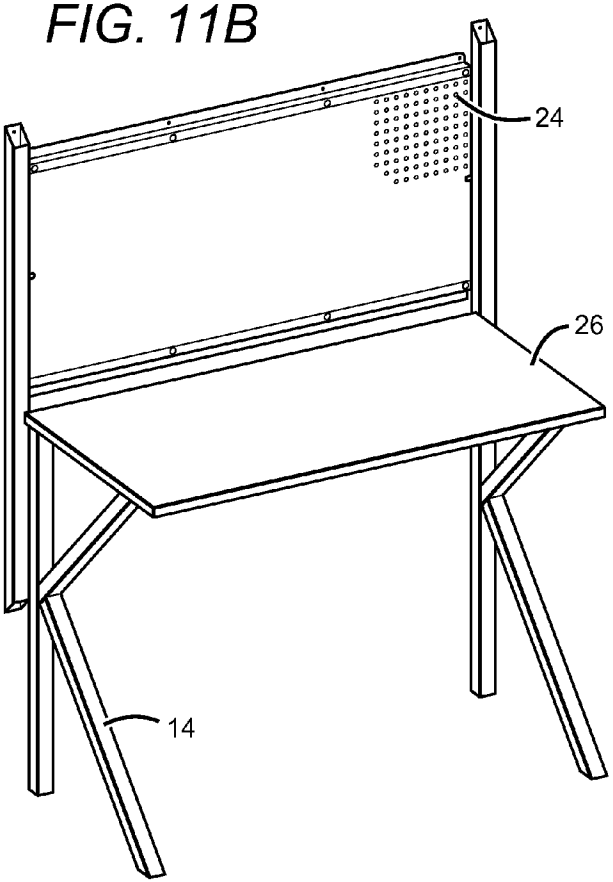
FIG. 11B is a front perspective view of the work bench station of FIG. 11A in its working configuration.

A second exemplary embodiment is shown in FIGS. 10A to 10D. This embodiment is generally similar to the embodiment shown in FIGS. 1A-1D. However, in this embodiment, the tabletop 26 may be lifted to allow the K-shaped end supports 14 to be folded inwardly towards the wall to their storage positions. The tabletop 26 can then swing downwardly to a storage position as shown in FIG. 11A. A capturing bracket 54 (FIG. 9) is mounted on the underside of the tabletop 26 to receive the wall brackets 12 when the tabletop is lowered into its storage position. When the tabletop 26 is folded down, any tools on the pegboard remain in plain view for access.

A third exemplary embodiment is shown in FIGS. 11A-11D. This embodiment is similar to that of FIGS. 1A-1D except that the manner in which the end supports 14 engage the tabletop 26 and the manner in which the tabletop 26 is maintained in its folded position. As to the former, a pin 56 extends upwardly from the top of the horizontal plate of the K-shaped end support 14 and engages a hole 58 in the bottom of the tabletop 26. This prevents movement of end supports 14 relative to the tabletop 26 when the workbench station is in its working configuration. As to the latter, the tabletop 26 of the work bench station folds upwardly and is maintained in place by locking bracket 38 (FIG. 8) which extends through a slot 42 in the upper pegboard frame member 40 (FIG. 6). The locking bracket 38 can be raised and lowered along a length of a pin that extends through aligned holes in the upper pegboard frame member 40 and locking bracket 38, generally as shown in FIG. 12K. The locking bracket 38 may be lifted and dropped over the edge of the work bench tabletop 26 as shown in FIG. 10A.

In this embodiment, the hinge bracket 23 (FIG. 4B) is dimensioned such that, when the tabletop 26 is pivoted to its storage position, it is spaced-apart from the pegboard panel 24.

FIGS. 12A through 12K show two versions of a fourth exemplary embodiment of the invention. This embodiment is generally similar to the embodiments of FIGS. 2A to 2D. In this embodiment, the tabletop 26 extends to the outer lateral edges of the wall brackets 12 (as shown, for example, in FIGS. 12B and 12D) and the hinge bracket 22 is pivotally secured to the outer lateral surface of the wall brackets 12. The difference between the two versions is the particular dimensions of the hinge bracket. The hinge bracket 50 of the second version shown in FIGS. 12C, 12D, 12G, 12H and 12J results in a greater spacing between the pegboard panel 24 and tabletop 26, when the tabletop 26 is in its stored position than the hinge bracket 48 of the first version shown in FIGS. 12A, 12B, 12E, 12F, and 12I. Further, the upper pegboard frame member 44 of the second version has a greater front to back width than the upper pegboard frame member 46 of the first version. The positions of attachment are such that the work bench tabletop can swing up to a vertical storage position that is spaced-apart from the pegboard at a selected distance to accommodate tools of different sizes that are mounted on the pegboard. The distance between the pegboard and the wood top in its vertical position can be varied by varying the points of attachments of the L-shaped bracket to the wall support tube as shown, for example, in FIGS. 4B and 4D. The hinge brackets having multiple holes may be used to afford an owner of the option of selecting among more than one position of attachment which, in turn, allows the owner to control the spacing between the pegboard panel and the tabletop in its stored position. In this embodiment, the latching mechanism as shown in FIG. 12K is generally the same as that described in the reference to the embodiment of FIGS. 10A-10D. Specifically, the locking bracket 38 (see FIG. 8) extends through a slot in the upper frame member 44, 46 and can be raised and lowered along a pin or bolt 52.

Figure 13B:
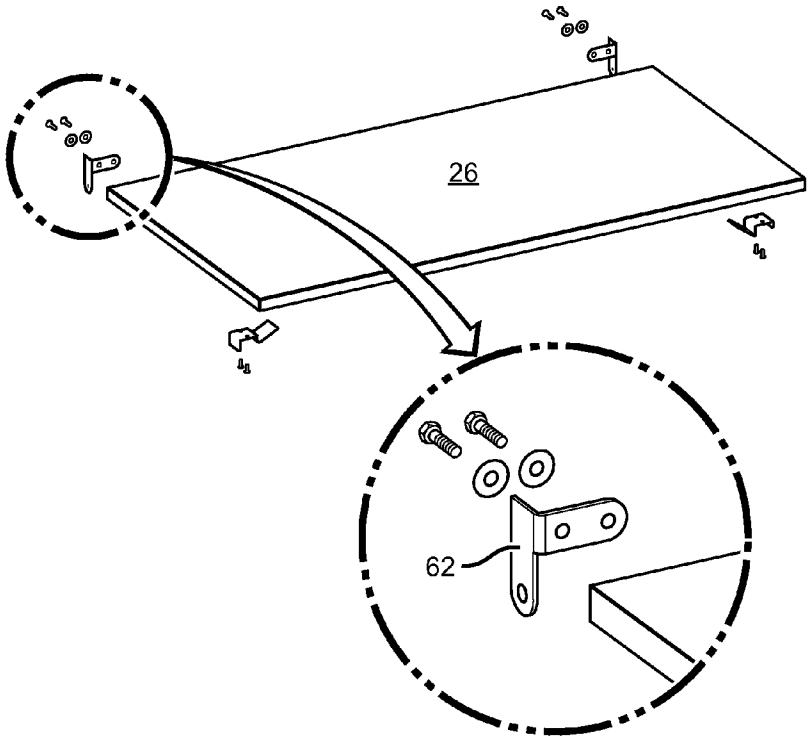
FIG. 13B is an enlarged view of the tabletop hinge of the work bench station of FIG. 13A.
Figure 13A:
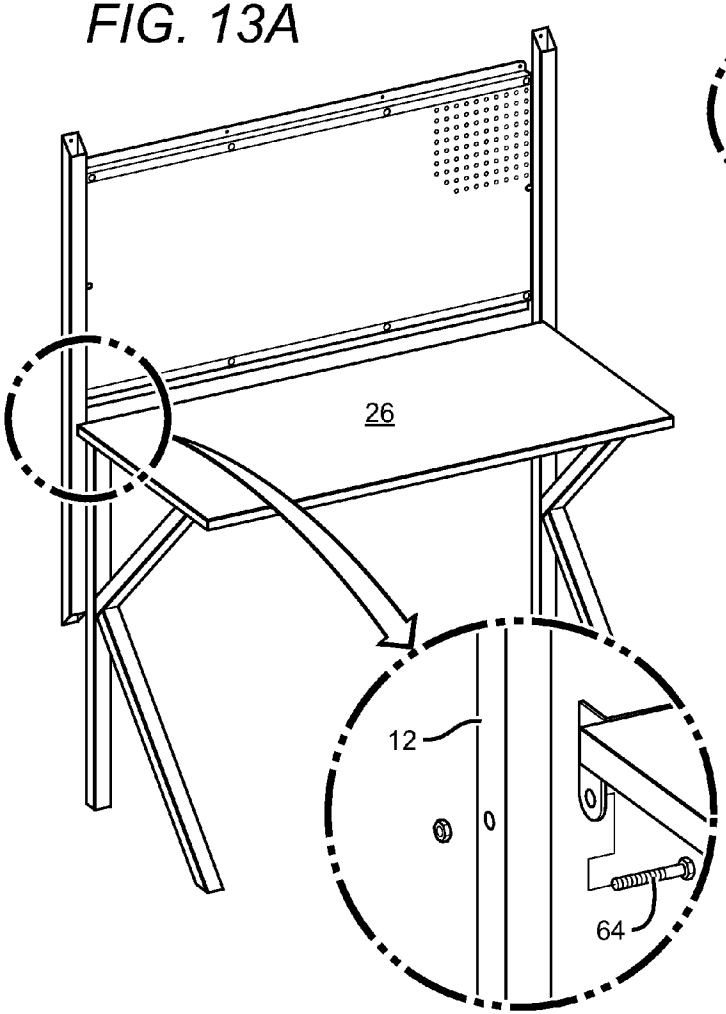
FIG. 13A is a front perspective view of another embodiment of the invention.

An exemplary embodiment using an alternate tabletop hinge comprising a hinge bracket 62 and pin 64 is shown in FIG. 13A and 13B.

Figure 14A:
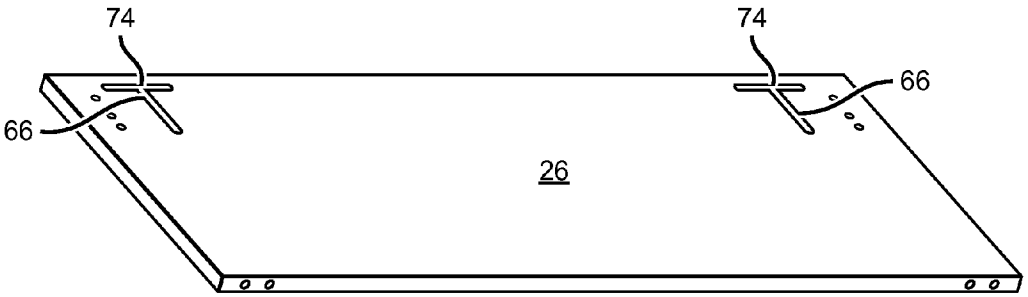
FIG. 14A is a bottom perspective view of a tabletop of another embodiment of the invention.
Figure 14C:
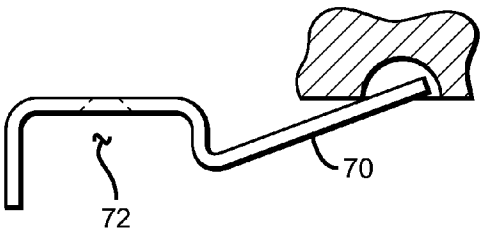
FIG. 14C is a side view of the bracket of FIG. 14B and a cut-away, cross-sectional view of a portion of the tabletop showing engagement of the bracket ramp with a groove in the tabletop.
Figure 14B:
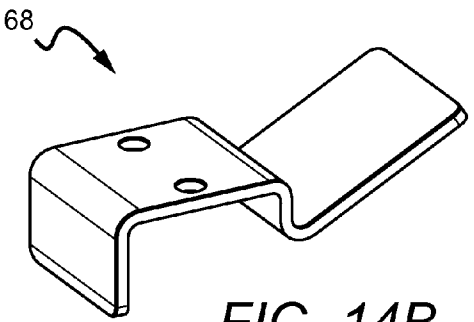
FIG. 14B is a perspective view of a bracket mountable on the tabletop of FIG. 14A for engaging an end support.

An exemplary embodiment comprising an alternate engagement mechanism between the tabletop and end supports is shown in FIGS. 14A-14C. As shown in FIG. 14A, the bottom of the tabletop 26 has a groove 66 generally parallel to each side edge of the tabletop. A bracket 68 as shown in FIG. 14B is mounted on the bottom side of the tabletop 26 in a manner to create a ramp 70 and a recess 72 that slidably engages the top surface of the end supports 14 as they are moved from their storage position to their working position. That is, as the end supports 14 are moved outwardly, they engage the ramp 70 and lift the tabletop 26 slightly until the tops of the end supports are received into the recess 72.

FIG. 14A also shows a groove 74 generally parallel to front edge of the tabletop that can be used as a finger hold when lifting and lowering the tabletop 26.

Although the present invention has been described through the use of exemplary embodiments, it will be appreciated by those of skill in the art that various modifications may be made to the described embodiments that fall within the scope and spirit of the invention as defined by the claims and their equivalents appended hereto. For example, aspects shown above with particular embodiments may be combined with or incorporated into other embodiments. As another example, any suitable panel material may be used rather than conventional pegboard. Moreover, while the embodiments are described as including a panel, e.g., pegboard panel, such a panel is optional and the dimensions of the panel are strictly a matter of design choice. Similarly, the hinge mechanism, locking mechanism for maintaining the tabletop in its storage position and the manner in which the tabletop engages the end supports when it is in its working position are described with respect to the specific structures shown in the drawings. It is understood that any suitable hinge and/or tabletop locking mechanism and/or tabletop-end support engagement mechanism may be used.

What is claimed is:

1. A work bench station comprising:

at least one right and one left wall bracket mountable to a generally vertical wall of a building;

a tabletop hingedly attached to the wall brackets such that the tabletop is configured to swing from a generally horizontal working position downwardly to a generally vertical down storage position;

right and left generally planar end supports that support and releaseably engage the tabletop in its working position, said end supports being hingedly connected to the wall brackets such that when the wall brackets are mounted on a wall of a building, the end supports can swing inwardly from a working position to a storage position lying generally flat against the wall on which the wall brackets are mounted; and a pair of brackets mounted on a bottom surface of the tabletop, wherein, when the tabletop is in the vertical down storage position, the brackets receive the wall brackets to detachably retain the tabletop in the down storage position.

2. The work bench station of claim 1, further comprising a generally vertical panel fixedly attached to and extending between the wall brackets at a position above the tabletop when the tabletop is in its working position.

3. The work bench station of claim 1, wherein the wall brackets comprise a pair of generally vertically oriented metal tubes having a square cross-sectional configuration.

4. The work bench station of claim 1, wherein the right and left generally planar end supports comprise right and left K-shaped end supports.

5. The work bench station of claim 1, wherein the brackets mounted on the bottom surface of the tabletop top are U-shaped.

6. The work bench station of claim 2, wherein the generally vertical panel comprises pegboard.

7. The work bench station of claim 1, further comprising first and second brackets coupled to a bottom surface of the tabletop, each bracket defining a ramp and a recess, wherein, as the end supports swing outward from the storage position to the working position, the end support units slide along the ramps and into the recesses in the brackets.

8. A work bench station, comprising:

a pair of wall brackets configured to be mounted to a structure;

a tabletop hingedly coupled to the wall brackets such that the tabletop is configured to swivel between a generally horizontal working position and a generally vertical up storage position;

a generally vertical panel fixedly attached to and extending between the wall brackets at a position above the tabletop when the tabletop is in its working position;

a pair of end supports hingedly coupled to the wall brackets, wherein the end supports are configured to swivel between a stored position generally co-planar with the generally vertical panel and a working position in which the end supports releasably engage and support the tabletop in its generally horizontal working position; and wherein the end supports are releasably coupled to the generally vertical panel when the end supports are in the stored position.

9. The work bench station of claim 8, wherein the vertical panel comprises pegboard.

10. The work bench station of claim 8, further comprising at least one support member coupled to the vertical panel and extending between the pair of wall brackets.

11. The work bench station of claim 8, further comprising:

at least one pin projecting upward from each of the end supports; and a plurality of apertures in a bottom surface of the tabletop corresponding to the pins, wherein the pins are received in the apertures when the end supports are supporting the tabletop in its generally horizontal working position.

12. The work bench station of claim 8, further comprising a locking mechanism for detachably maintaining the tabletop in its vertical up storage position.

13. The work bench station of claim 12, wherein the locking mechanism comprises a locking bracket slidable along a length of a pin, wherein the locking bracket is configured to be raised to disengage the tabletop and lowered to engage the tabletop.

14. The work bench station of claim 8, further comprising at least one rosette head bolt coupled to each of the end supports, the rosette head bolts engaging a bottom surface of the tabletop when the end supports are supporting the tabletop in its generally horizontal working position.

15. A work bench station, comprising:

a pair of wall brackets configured to be mounted to a structure;

a tabletop;

a pair of adjustable hinges hingedly coupling the tabletop to the pair of wall brackets such that the tabletop is configured to swivel between a generally horizontal working position and a generally vertical up storage position;

a generally vertical panel fixedly attached to and extending between the wall brackets at a position above the tabletop when the tabletop is in its working position;

a pair of end supports hingedly coupled to the wall brackets, wherein the end supports are configured to swivel between a stored position generally co-planar with the generally vertical panel and a working position in which the end supports releasably engage and support the tabletop in its generally horizontal working position; and wherein the adjustable hinges are configured to be adjusted between a first position in which the tabletop in the vertical up storage position is spaced apart from the vertical panel by a first distance and a second position in which the tabletop in the vertical up storage position is spaced apart from the vertical panel by a second distance.

16. The work bench station of claim 15, wherein the second distance is greater than a width of a tool mounted on the vertical panel.

17. The work bench station of claim 15, wherein the generally vertical panel comprises pegboard.

18. The work bench station of claim 15, further comprising a locking mechanism for detachably maintaining the tabletop in its vertical up storage position.

19. The work bench station of claim 15, wherein the end supports are K-shaped.

* * * * *